US009728840B2

(12) United States Patent
Shi et al.

(10) Patent No.: US 9,728,840 B2
(45) Date of Patent: Aug. 8, 2017

(54) DISPLAY PANEL AND MANUFACTURING METHOD THEREOF, DISPLAY DEVICE

(71) Applicant: BOE TECHNOLOGY GROUP CO., LTD., Beijing (CN)

(72) Inventors: Shiming Shi, Beijing (CN); Tao Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 392 days.

(21) Appl. No.: 14/068,462

(22) Filed: Oct. 31, 2013

(65) Prior Publication Data

US 2014/0125533 A1 May 8, 2014

(30) Foreign Application Priority Data

Nov. 2, 2012 (CN) ..... 2012 1 0435119

(51) Int. Cl.
*H01Q 1/24* (2006.01)
*H01Q 1/38* (2006.01)
*H01Q 1/44* (2006.01)

(52) U.S. Cl.
CPC ..... *H01Q 1/243* (2013.01); *H01Q 1/38* (2013.01); *H01Q 1/44* (2013.01); *Y10T 29/49018* (2015.01)

(58) Field of Classification Search
CPC .. H01Q 1/22; H01Q 1/38; H01Q 1/44; H01Q 1/243
See application file for complete search history.

(56) References Cited

U.S. PATENT DOCUMENTS 6,417,817 B1 * 7/2002 Pirila ..... H01Q 1/243 343/700 MS
2002/0152606 A1 * 10/2002 Huang ..... H01Q 1/243 29/601
2004/0189625 A1 9/2004 Sato
2010/0321325 A1 * 12/2010 Springer ..... G06F 3/041 345/174
2011/0193753 A1 * 8/2011 Kim ..... H01Q 1/241 343/702
2013/0106677 A1 * 5/2013 Koo ..... G11C 19/28 345/87

FOREIGN PATENT DOCUMENTS

CN 1530878 A 9/2004

OTHER PUBLICATIONS

First Office Action issued by the Chinese Patent Office for Chinese Patent Application No. 2012104351192 dated Aug. 26, 2014, 7pgs.
English translation of First Office Action issued by the Chinese Patent Office for Chinese Patent Application No. 2012104351192 dated Aug. 26, 2014, 5pgs.

(Continued)

*Primary Examiner* — Dieu H Duong
(74) *Attorney, Agent, or Firm* — Ladas & Parry LLP

(57) ABSTRACT

A display panel comprises a first substrate and a second substrate which are arranged opposite to each other, and an antenna pattern is formed on the inside or the outside of the first substrate and includes a feed point and a ground point; the feed point is connected with a transceiver in a display device; and the ground point is connected with a ground wire of the transceiver.

8 Claims, 4 Drawing Sheets

(56) References Cited

OTHER PUBLICATIONS

Second Office Action (Chinese language) issued by the Chinese Patent Office for Chinese Patent Application No. 201210435119.2 dated Feb. 12, 2015, 4 pgs.
English translation of Second Office Action issued by the Chinese Patent Office for Chinese Patent Application No. 201210435119.2 dated Feb. 12, 2015, 3 pgs.

* cited by examiner

DISPLAY PANEL AND MANUFACTURING METHOD THEREOF, DISPLAY DEVICE

CROSS REFERENCE TO RELATED APPLICATIONS

This application claims priority from Chinese National Application No. 201210435119.2 filed on Nov. 2, 2012, the contents of which are incorporated herein by reference.

TECHNICAL FIELD

Embodiments of the present technical disclosure relate to a display panel, a manufacturing method thereof, and a display device.

BACKGROUND

Displays are important output devices for electronic display apparatuses. Wireless displays can receive signals through antennas, so that video signal lines are not required any more, and hence the displays can be more easily placed at random and better use experience can be afforded for users.

There are two types of antennas for the traditional wireless displays. One type relates to the antenna that is externally connected to a display panel of a display, and this type of antenna has mounting problem and is vulnerable for damages as being connected to the outside of the display panel; and the other relates to the antenna that is directly integrated into a printed circuit board (PCB) of the display, but the antenna cannot be used in a display device without a PCB.

SUMMARY

The embodiments of the present technical disclosure provide a display panel, a manufacturing method thereof and a display device. The display panel does not need an externally arranged antenna and hence cannot be easily damaged, and the design of the display device without the PCB can be achieved.

According to one aspect of the present technical disclosure, a display panel is provided. The display panel comprises a first substrate and a second substrate which are arranged opposite to each other, and an antenna pattern is formed on an inside or an outside of the first substrate and includes a feed point and a ground point; the feed point is connected with a transceiver in a display device; and the ground point is connected with a ground wire of the transceiver.

For instance, the antenna pattern is disposed in a non-display area of the display panel.

For instance, a driver chip and a flexible circuit are bound on an edge on the inside of the first substrate; and the antenna pattern is formed on an edge, opposite to the edge where the driver chip and the flexible circuit are bound, on the inside of the first substrate.

For instance, a pattern of a gate line and a gate electrode and a pattern of a data line, a source electrode and a drain electrode are at least formed on the first substrate; and the antenna pattern is disposed on a same layer as the pattern of the gate line and the gate electrode; or, the antenna pattern is disposed on a same layer as the pattern of the data line, the source electrode and the drain electrode.

For instance, an insulating layer pattern is disposed on a portion of the antenna pattern except the feed point and the ground point.

For instance, a first conductive layer pattern is disposed on the feed point; a second conductive layer pattern is disposed on the ground point; and the first conductive layer pattern and the second conductive layer pattern are not connected with each other.

For instance, an electrode pattern is at least formed on the first substrate; and the conductive layer patterns and the electrode pattern are disposed on a same layer.

According to another aspect of the present technical disclosure, a method for manufacturing a display panel is provided. The manufacturing method comprises: forming the display panel by cell-assembling a first substrate and a second substrate. Moreover, before the step of forming the display panel by cell-assembling the first substrate and the second substrate, the manufacturing method further comprises: preparing a metallic film on the inside or the outside of the first substrate, and at least forming an antenna pattern by a patterning process, in which the antenna pattern includes a feed point and a ground point; the feed point is connected with a transceiver in a display device; and the ground point is connected with a ground wire of the transceiver.

For instance, the metallic film is prepared on the inside of the first substrate, and the antenna pattern and a pattern of a gate line and a gate electrode are formed by one patterning process; or, the metallic film is prepared on the inside of the first substrate, and the antenna pattern and a pattern of a data line, a source electrode and a drain electrode are formed by one patterning process.

For instance, an insulating film is prepared on the first substrate on which the antenna pattern is at least formed, and an insulating layer pattern is formed by at least removing partial insulating film at positions corresponding to the feed point and the ground point by a patterning process.

For instance, a conductive film is prepared on the first substrate on which the insulating layer pattern is at least formed, and at least a first conductive layer pattern and a second conductive layer pattern, which are not connected with each other, are formed by a patterning process, in which the first conductive layer pattern is connected with the feed point, and the second conductive layer pattern is connected with the ground point.

For instance, a conductive film is prepared on the first substrate on which the insulating layer pattern is at least formed, the first conductive layer pattern, the second conductive layer pattern and an electrode pattern are formed by one patterning process.

According to still another aspect of the present technical disclosure, a display device is provided. The display device comprises the foregoing display panel.

For instance, the display device further comprises a backlight unit (BLU).

For instance, through holes are formed at positions on the BLU, corresponding to the feed point and the ground point respectively; or, conductive devices are arranged inside the BLU and respectively connected with the feed point and the ground point; or, through holes are formed at positions of the first substrate, corresponding to the feed point and the ground point respectively, and through holes are formed at positions on the BLU, corresponding to the feed point and the ground point respectively; or, through holes are formed at positions of the first substrate, corresponding to the feed point and the ground point respectively, and conductive devices are arranged inside the BLU and respectively connected with the feed point and the ground point via the through holes on the first substrate.

Further scope of applicability of the present technical disclosure will become apparent from the detailed description given hereinafter. However, it should be understood that the detailed description and specific examples, while indicating preferred embodiments of the technical disclosure, are given by way of illustration only, since various changes and modifications within the spirit and scope of the technical disclosure will become apparent to those skilled in the art from the following detailed description.

BRIEF DESCRIPTION OF THE DRAWINGS

The present technical disclosure will become more fully understood from the detailed description given hereinafter and the accompanying drawings which are given by way of illustration only, and thus are not limitative of the present technical disclosure and wherein.

Figure 1:
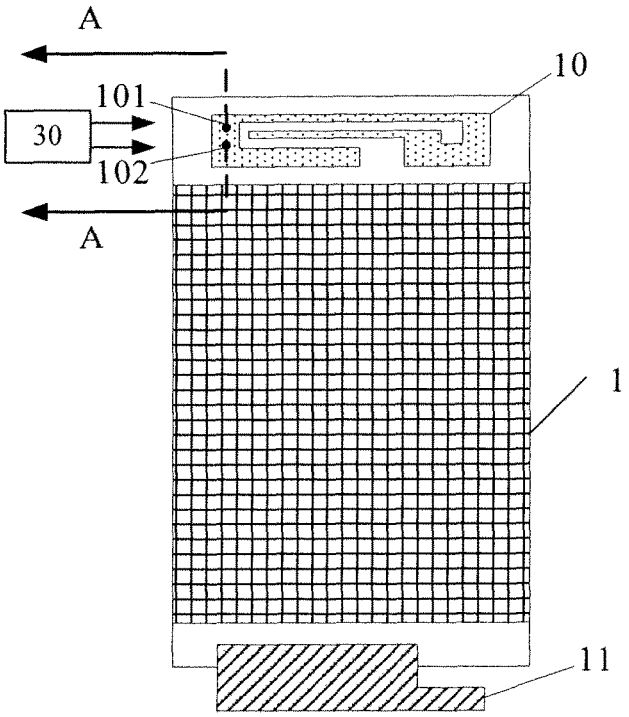
FIG. 1 is a top view of a first substrate of a display panel according to an embodiment of the present technical disclosure.

Reference numerals in the accompanying drawings:

1—first substrate, 2—second substrate, 3—Backlight Unit, 10—antenna pattern, 11—driver chip and flexible circuit, 21—pattern of a gate line and a gate electrode, 22—pattern of a data line, a source electrode and a drain electrode, 23—electrode pattern, 24—passivation layer pattern, 25—gate insulating layer pattern, 12—through hole on the first substrate; 101—feed point, 102—ground point, 111—first conductive layer pattern, 112—second conductive layer pattern, 113—insulating layer pattern, 301—throug hole on the BLU, 302—conductive device.

DETAILED DESCRIPTION

According to one embodiment of the present technical disclosure, a display panel is provided. The display panel comprises a first substrate and a second substrate which are arranged opposite to each other. As illustrated in FIG. 1, an antenna pattern 10 is formed on the inside or the outside of the first substrate 1 and includes a feed point 101 and a ground point 102, in which the feed point 101 is connected with a transceiver 30 in a display device, and the ground point 102 is connected with a ground wire of the transceiver 30.

One side of the first substrate, opposite to the second substrate, is referred to as the inside of the first substrate, and the other side is referred to as the outside of the first substrate. The antenna pattern is disposed on the inside or the outside of the first substrate, and the shape and the thickness of the antenna pattern can be determined by the material, the service wave band, the gain and the efficiency of the actually required antenna pattern. The antenna pattern receives a signal and transmits the signal to the transceiver 30 in the display device through the feed point 101; the transceiver 30 transmits a signal to be emitted to the antenna pattern through the feed point 101; and hence the signal is emitted. In this way, the wireless communication function of the display device can be achieved.

In the embodiment, the antenna pattern is disposed on the inside or the outside of the first substrate of the display panel. Therefore, the mounting problem occurred in an externally arranged antenna can be avoided; the display panel cannot be easily damaged; and the design of a display panel without a PCB can be achieved as well.

In general, the antenna pattern may be made of a metallic material such as Mo, AlNd, Al, Cu, Ag or Au. Metallic materials are mostly opaque materials. For instance, the antenna pattern 10 may be disposed in a non-display area of the display panel. The non-display area refers to an area, in the display panel, that is not configured to display images. As the antenna pattern 10 made of the opaque materials is disposed in the non-display area, the display effect of the display panel will not be affected. Of course, if the antenna pattern is made of a transparent material, the antenna pattern may also be formed in any area of the display panel, including a display area.

As illustrated in FIG. 1, a driver chip and a flexible circuit 11 are bound on an edge on the inside of the first substrate 1. Meanwhile, when the antenna pattern is formed on the inside of the first substrate 1, for instance, the antenna pattern 10 is formed on an edge opposite to the edge where the driver chip and the flexible circuit 11 are provided. Therefore, the interference of the driver chip and the flexible circuit 11 on wireless signals can be avoided.

In the embodiment of the present technical disclosure, the display panel may be a liquid-crystal display (LCD) panel or an organic light-emitting diode (OLED) display panel.

Figure 2:
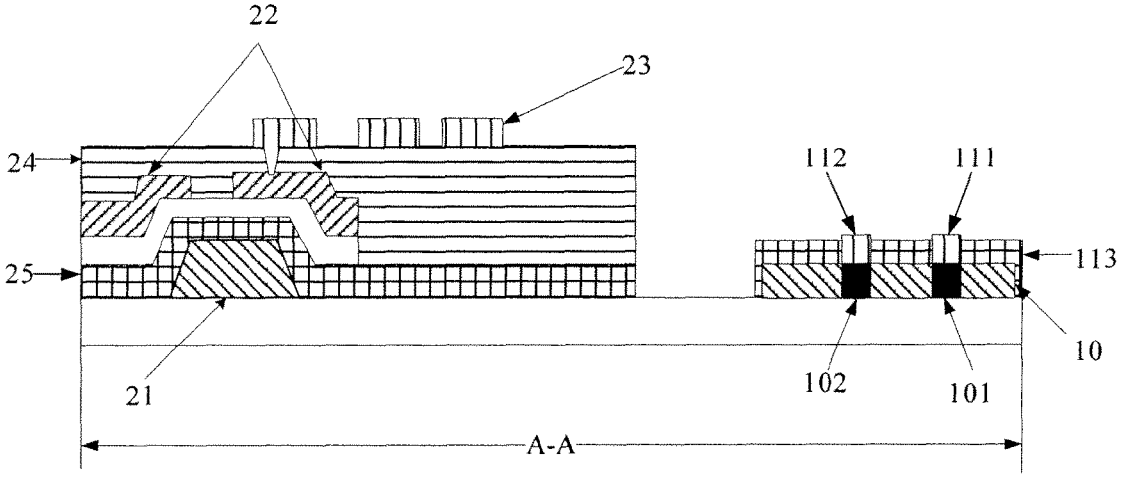
FIG. 2 is a sectional view of the first substrate of the display panel according to an embodiment of the present technical disclosure.
Figure 3:
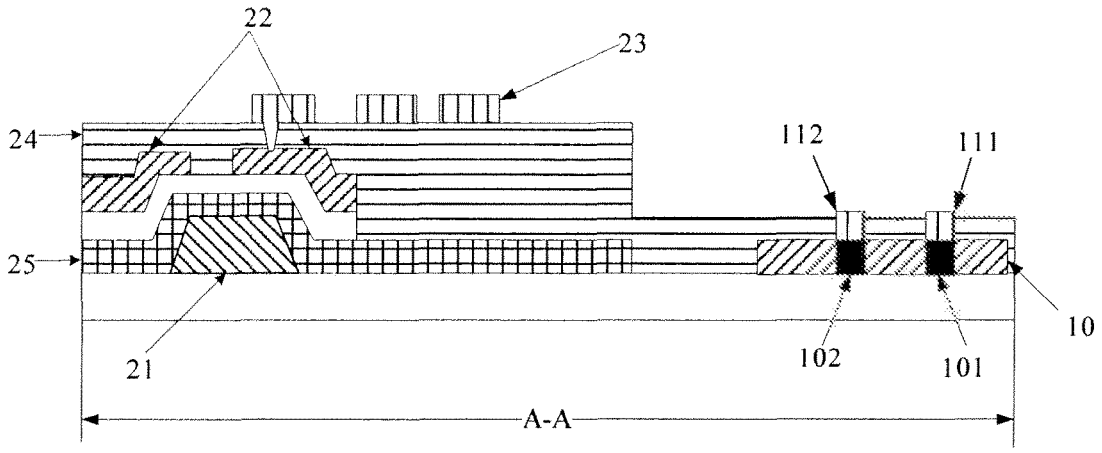
FIG. 3 is a sectional view of a first substrate of another display panel according to an embodiment of the present technical disclosure.

When the display panel is an LCD panel, the first substrate 1 may be an array substrate or a color filter substrate. Given that the first substrate is an array substrate, FIGS. 2 and 3 are schematic structural sectional views of the first substrate along the A-A section line direction according to embodiments. In addition, a pattern 21 of a gate line and a gate electrode and a pattern 22 of a data line, a source electrode and a drain electrode are at least formed on the first substrate. For instance, as illustrated in FIG. 2, the antenna pattern 10 is disposed on the same layer as the pattern 21 of the gate line and the gate electrode; or, as illustrated in FIG. 3, the antenna 10 is disposed on the same layer as the pattern 22 of the data line, the source electrode and the drain electrode.

Herein, disposing on a same layer or on different layers is described in view of at least two patterns. The case that at least two patterns are disposed on the same layer refers to that: at least two patterns are formed by a same film through a patterning process. For instance, the case that the antenna pattern is disposed on the same layer as the pattern of the gate line and the gate electrode refers to that: the antenna pattern and the pattern of the gate line and the gate electrode are formed by a same gate electrode metallic film via a patterning process. As the antenna pattern is disposed on the same layer as the pattern of the gate line and the gate electrode or disposed on the same layer as the pattern of the data line, the source electrode and the drain electrode, and the manufacturing process of the display panel will not be changed, no additional cost can be incurred.

Moreover, as illustrated in FIG. 2 or 3, conductive layer patterns 11 are respectively disposed on the feed point 101 and the ground point 102 in the antenna pattern 10, and an insulating layer pattern 113 is disposed on the antenna pattern except the feed point 101 and the ground point 102.

In order to prevent the antenna pattern from being eroded, an insulating layer pattern is disposed on the antenna pattern 10. As the feed point 101 and the ground point 102 must be exposed and respectively connected with the transceiver and the ground wire, the insulating layer pattern cannot be disposed on the feed point 101 and the ground point 102.

For instance, in order to prevent the feed point and the ground point from being oxidized and improve the connecting strength of the transceiver and the ground wire, the conductive layer patterns are disposed on the feed point 101 and the ground point 102 in the antenna pattern, in which a first conductive layer pattern 111 is disposed on the feed point 101 and a second conductive layer pattern 112 is disposed on the ground point 102; and the first conductive layer pattern 111 and the second conductive layer pattern 112 are not connected with each other. For instance, the conductive layer patterns may be made of indium tin oxide (ITO).

Preferably, an electrode pattern 23 is at least formed on the first substrate. Herein, the electrode pattern may be a pattern of a pixel electrode or may be a pattern of a common electrode. As illustrated in FIGS. 2 and 3, the electrode pattern 23 in the first substrate is the pattern of a pixel electrode. The conductive layer patterns 111 and 112 are disposed on the same layer as the electrode pattern 23. In this way, the manufacturing process of the display panel is still not required to be changed and hence no additional cost can be incurred.

Moreover, a gate insulating layer pattern and a passivation layer pattern are at least formed in the first substrate. As illustrated in FIG. 2, the insulating layer pattern 113 may be disposed on the same layer as the gate insulating layer pattern 25. As illustrated in FIG. 3, the insulating layer pattern may also be that: two through holes are formed in the passivation layer pattern 24 and disposed on the feed point and the ground point respectively.

In the above examples, the antenna pattern is disposed on the inside of the first substrate. Of course, the antenna pattern can also be disposed on the outside of the first substrate, namely the antenna pattern is disposed on the side of the transparent substrate of the first substrate, facing away from the second substrate. For instance, an insulating layer pattern may also be disposed on a portion of the antenna pattern except the feed point and the ground point. Moreover, for instance, a first conductive layer pattern is disposed on the feed point; a second conductive layer pattern is disposed on the ground point; and the first conductive layer pattern and the second conductive layer pattern are not connected with each other.

When the first substrate is a color filter substrate, the antenna pattern is disposed on the outside or the inside of the transparent substrate of the first substrate. The additionally arranged antenna pattern does not change the rest structures of the original color filter substrate. For instance, an insulating layer pattern may also be disposed on a portion of the antenna pattern except the feed point and the ground point. Moreover, for instance, a first conductive layer pattern is disposed on the feed point; a second conductive layer pattern is disposed on the ground point; and the first conductive layer pattern and the second conductive layer pattern are not connected with each other.

When the display panel is an OLED display panel, the antenna pattern is disposed on the outside or the inside of a transparent substrate of the first substrate. The additionally arranged antenna pattern does not change the rest structures of the original OLED substrate. For instance, an insulating layer pattern may also be disposed on a portion of the antenna pattern except the feed point and the ground point. Moreover, for instance, a first conductive layer pattern is disposed on the feed point; a second conductive layer pattern is disposed on the ground point; and the first conductive layer pattern and the second conductive layer pattern are not connected with each other.

According to another embodiment of the present technical disclosure, a method for manufacturing the display panel is provided. The manufacturing method comprises the following step of: forming the display panel by cell-assembling a first substrate and a second substrate. Before the step of forming the display panel by cell-assembling the first substrate and the second substrate, that is, disposing the first substrate and the second substrate opposite to each other to form a cell, the manufacturing method further comprises the following processes.

A metallic film is prepared on the inside or the outside of the first substrate, and at least an antenna pattern is formed by a patterning process, and the antenna pattern includes a feed point and a ground point; the feed point is connected with a transceiver in a display device; and the ground point is connected with a ground wire of the transceiver.

For instance, the metallic film is prepared on the inside or the outside of the first substrate, and the antenna pattern is formed by the patterning process including exposing, developing, etching and the like. For instance, the antenna pattern may be made of a metallic material such as Mo, AlNd, Al, Cu, Ag or Au.

The manufacturing process for the first substrate and the second substrate may adopt the same process as the traditional manufacturing process for the first substrate and the second substrate, and will not be further described herein.

When the display panel is an LCD panel, a liquid crystal cell is manufactured by the module process for the first substrate and the second substrate, including such as polyimide (PI) coating, alignment treatment, liquid crystal dropping, sealant coating, and cell-assembling, and then the display panel is manufactured by cleaning, polarizer attaching binding of a driver chip and a flexible circuit board, or the like.

When the display panel is an OLED display panel, the antenna pattern may also be prepared on the substrate of the OLED display panel by the above method.

For instance, after the antenna pattern is prepared, in order to prevent the antenna pattern from being eroded, an insulating film may further be prepared on the first substrate on which the antenna pattern is at least formed, and an insulating layer pattern is formed by at least removing partial insulating film at positions corresponding to the feed point and the ground point by a patterning process.

Moreover, for instance, in order to prevent the feed point and the ground point from being eroded, a conductive film may further be prepared on the first substrate on which the insulating layer pattern is at least formed, and a first conductive layer pattern and a second conductive layer pattern, which are not connected with each other, are at least formed by a patterning process, in which the first conductive layer pattern is connected with the feed point, and the second conductive patter is connected with the ground point.

In the embodiment of the present technical disclosure, when the antenna pattern is prepared on the outside of the first substrate, the manufacturing process of the first substrate and the second substrate may be the same as the traditional manufacturing process of the first substrate and the second substrate, and will not be further described herein. After the first substrate is manufactured, the antenna pattern may be prepared by the above method, and hence the display panel may be formed through cell-assembling and so on. When the antenna pattern is independently prepared on the inside of the first substrate, the antenna pattern may be prepared by the above method; the first substrate and the second substrate are manufactured by the traditional manufacturing process; and hence the display panel is formed by cell-assembling and so on.

When the display panel is an LCD panel and the first substrate is an array substrate, in order to reduce the manufacturing flow, the step of preparing the metallic film on the inside of the first substrate and at least forming the antenna pattern by the patterning process can be conducted, for example, by preparing the metallic film on the inside of the first substrate and forming the antenna pattern and a pattern of a gate line and a gate electrode by one patterning process; or, preparing the metallic film on the inside of the first substrate and forming the antenna pattern and a pattern of a data line, a source electrode and a drain electrode by one patterning process. Moreover, preferably, the step of preparing the conductive film on the first substrate on which the insulating layer pattern is at least formed, and at least forming the first conductive layer pattern and the second conductive layer pattern, which are not connected with each other, by the patterning process can be conducted, for example, by preparing the conductive film on the first substrate on which the insulating layer pattern is at least formed, and forming the first conductive layer pattern, the second conductive layer pattern and an electrode pattern by one patterning process.

The first substrate illustrated in FIG. 2 is taken for example, and the method for manufacturing the first substrate may comprise the following processes of:

S1: preparing a gate metallic film on a transparent substrate, and at least forming a pattern 21 of a gate line and a gate electrode and an antenna pattern 10 by a patterning process;

S2: preparing a gate insulating film on the transparent substrate on which the pattern 21 of the gate line and the gate electrode and the antenna pattern 10 are at least formed, and forming a gate insulating layer 25 and an insulating layer pattern 113 by a patterning process;

S3: preparing a semiconductor film on the transparent substrate on which the gate insulating layer 25 is formed, and forming an active layer by a patterning process;

S4: preparing a source/drain metallic film on the transparent substrate on which the active layer is formed, and at least forming a pattern 22 of a data line, a source electrode and a drain electrode by a patterning process;

S5: preparing a passivation layer film on the transparent substrate on which the pattern 22 of the data line, the source electrode and the drain electrode are at least formed, and forming a passivation layer pattern 24 provided with through holes by a patterning process; and S6: preparing a transparent conductive film on the transparent substrate on which the passivation layer pattern 24 is formed, and at least forming an electrode pattern 23 and a conductive layer pattern 10 by a patterning process.

The method for manufacturing the first substrate as illustrated in FIG. 3 may refer to the manufacturing method as illustrated in FIG. 2. The difference is that the above processes S1, S2, S4 and S5 are respectively replaced by the following processes Q1, Q2, Q4 and Q5, and the other processes may refer to the rest corresponding processes in FIG. 2:

Q1: preparing a metallic film on a transparent substrate, and at least forming a pattern 21 of a gate line and a gate electrode by a patterning process.

Q2: preparing a gate insulating film on the transparent substrate on which the pattern 21 of the gate line and the gate electrode is formed, and forming a gate insulating layer 25 by a patterning process.

Q4: preparing a source/drain metallic film on the transparent substrate on which the active layer is formed, and at least forming a pattern 22 of a data line, a source electrode and a drain electrode and an antenna pattern 10 by a patterning process.

Q5: preparing a passivation layer film on the transparent substrate on which the pattern 22 of the data line, the source electrode and the drain electrode is formed, and forming a passivation layer pattern 24 provided with through holes by a patterning process, in which two through holes in the through holes are respectively formed on the feed point and the ground point.

After the first substrate is manufactured by the above method, the second substrate can be manufactured by the traditional manufacturing process, and hence the first substrate and the second substrate are subjected to a cell-assembly process, and finally the display panel is manufactured after cleaning, polarizer attaching, binding of a driver chip and a flexible circuit board, and the like.

According to still another embodiment of the present technical disclosure, a display device is provided. The display device comprises the foregoing display panel and may be an LCD, an LCD TV, a digital picture frame, a mobile phone, a tablet PC or any other product or component with display function.

For instance, the display panel is an LCD panel, and FIGS. 4 to 8 illustrate side views of exemplary display devices, each of which comprises a first substrate 1 and a second substrate 2 of the display panel, and a backlight unit (BLU) 3.

Figure 4:
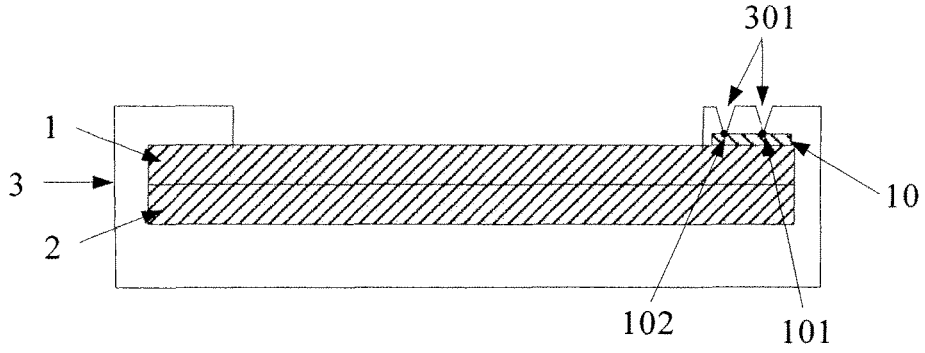
FIG. 4 is a side view of a display device according to an embodiment of the present technical disclosure.

For instance, as illustrated in FIG. 4, an antenna pattern 10 is disposed on the outside of the first substrate 1; through holes 301 are formed at positions on the BLU 3, corresponding to a feed point 101 and a ground point 102 respectively; the feed point 101 may be connected with a transceiver via the through hole 301; and the ground point 102 may be connected with a ground wire via the through hole 301. For instance, probes may further be inserted into the through holes 301, and the feed point 101 and the ground point 102 are led out through the probes and respectively connected with the transceiver and the ground wire. Of course, if the case is as illustrated in FIG. 5, the antenna pattern 10 is disposed on the inside of the first substrate 1, and through holes 301 may be formed at positions on the BLU 3, corresponding to the feed point 101 and the ground point 102 respectively; the feed point may be connected with the transceiver via the through hole 301; and the ground point 102 may be connected with the ground wire via the through hole 301.

Figure 5:
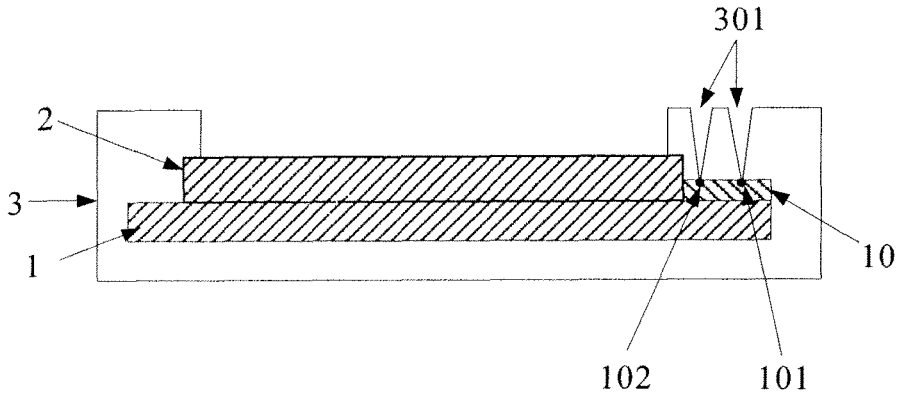
FIG. 5 is a side view of another display device according to an embodiment of the present technical disclosure.

Or, as illustrated in FIG. 5, conductive devices 302 can be arranged inside the BLU 3 and respectively connected with the feed point 101 and the ground point 102, and are configured to respectively lead out the feed point 101 and the ground point 102 so that the feed point 101 and the ground point 102 are respectively electrically connected with the transceiver and the ground wire.

Figure 6:
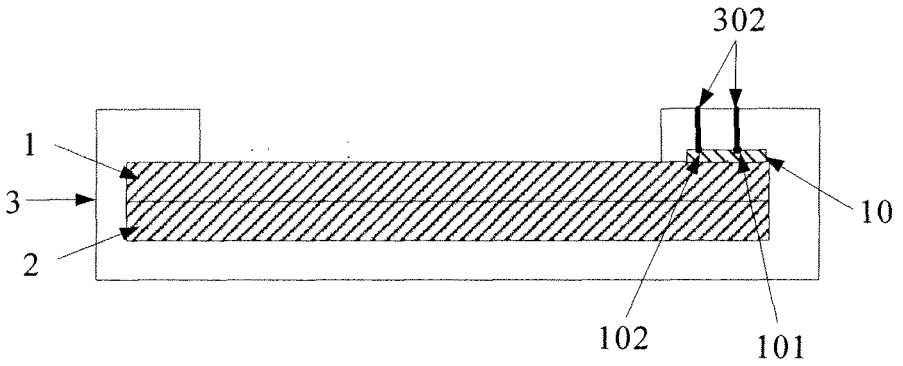
FIG. 6 is a side view of another display device according to an embodiment of the present technical disclosure.
Figure 7:
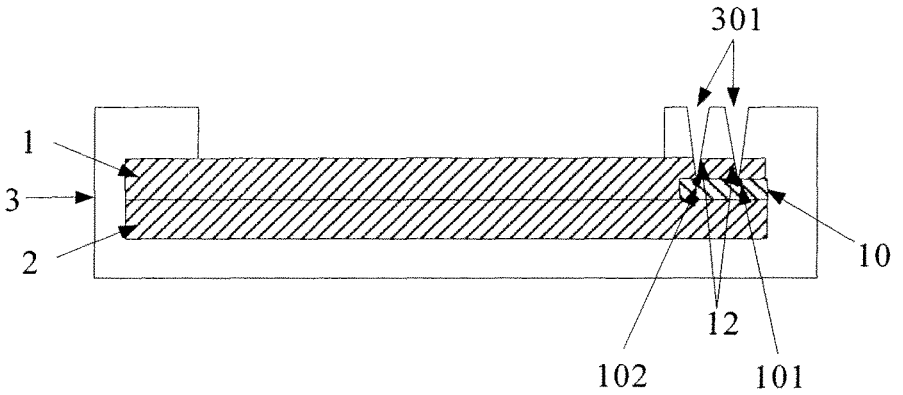
FIG. 7 is a side view of another display device according to an embodiment of the present technical disclosure.
Figure 8:
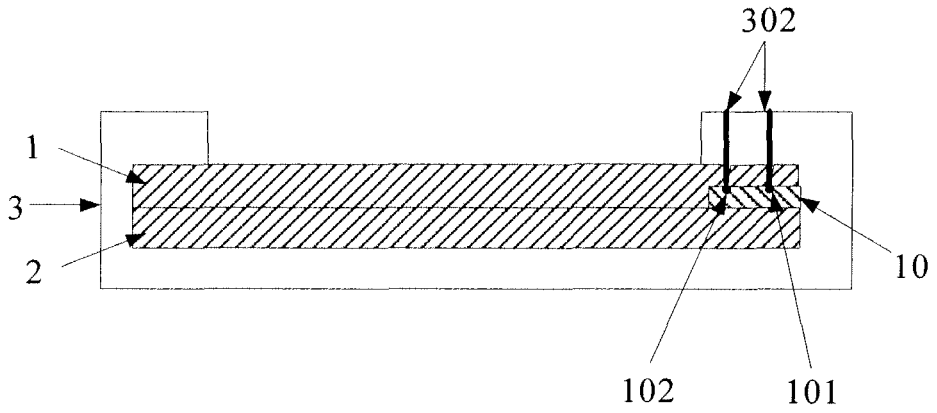
FIG. 8 is a side view of another display device according to an embodiment of the present technical disclosure.

As illustrated in FIGS. 6 and 7, the antenna pattern 10 is disposed on the inside of the first substrate 1 in the display panel; through holes 12 are formed at positions on the first substrate 1, corresponding to the feed point and the ground point respectively; preferably, as illustrated in FIG. 6, the through holes 301 are formed at positions on the BLU 3, corresponding to the feed point 101 and the ground point 102 respectively; the feed point 101 may be connected with the transceiver via the through hole 12 on the first substrate 1 and the through hole 301 on the BLU; and the ground point 102 may be connected with the ground wire via the through hole 12 on the first substrate and the through hole 301 on the BLU. Preferably, probes may further be inserted into the through holes 12 and the through holes 301, and the feed point 101 and the ground point 102 are led out by the probes and respectively electrically connected with the transceiver and the ground wire.

Or, as illustrated in FIG. 7, conductive devices 302 are arranged inside the BLU and respectively connected with the feed point 101 and the ground point 102, and are configured to lead out the feed point 101 and the ground point 102 so that the feed point 101 and the ground point 102 are respectively electrically connected with the transceiver and the ground wire.

The embodiment of the technical disclosure being thus described, it will be obvious that the same may be varied in many ways. Such variations are not to be regarded as a departure from the spirit and scope of the technical disclosure, and all such modifications as would be obvious to those skilled in the art are intended to be included within the scope of the following claims.

What is claimed is:

1. A display panel, comprising:

a first substrate and a second substrate arranged opposite to each other, wherein an antenna pattern is formed on a side of the first substrate facing the second substrate and includes a feed point and a ground point; the feed point is connected with a transceiver in a display device; the ground point is connected with a ground wire of the transceiver; a first conductive layer pattern is disposed on the feed point; a second conductive layer pattern is disposed on the ground point; the first conductive layer pattern and the second conductive layer pattern are not connected with each other; an electrode pattern is at least formed on the first substrate; the conductive layer patterns and the electrode patterns are disposed on a same layer; and the electrode pattern is a pattern of a pixel electrode or a pattern of a common electrode.

2. The display panel according to claim 1, wherein a driver chip and a flexible circuit are bound on an edge on the side of the first substrate facing the second substrate; the antenna pattern is formed on an edge, opposite to the edge where the driver chip and the flexible circuit are bound, on the side of the first substrate facing the second substrate.

3. The display panel according to claim 1, wherein an insulating layer pattern is disposed on a portion of the antenna pattern except the feed point and the ground point.

4. A display device, comprising the display panel according to claim 1.

5. The display device according to claim 4, wherein the display device further comprises a backlight unit (BLU).

6. The display device according to claim 5, wherein through holes are formed at positions on the BLU, corresponding to the feed point and the ground point respectively; or conductive devices are arranged inside the BLU and respectively connected with the feed point and the ground point;

or, through holes are formed at positions on the first substrate, corresponding to the feed point and the ground point respectively, and through holes are formed at positions on the BLU, corresponding to the feed point and the ground point respectively;

or, through holes are formed at positions of the first substrate, corresponding to the feed point and the ground point respectively, and conductive devices are arranged inside the BLU and respectively connected with the feed point and the ground point via the through holes on the first substrate.

7. The display panel according to claim 1, wherein a pattern of a gate line and a gate electrode and a pattern of a data line, a source electrode and a drain electrode are at least formed on the first substrate;

the antenna pattern is disposed on a same layer as the pattern of the gate line and the gate electrode; or, the antenna pattern is disposed on a same layer as the pattern of the data line, the source electrode and the drain electrode.

8. The display panel according to claim 1, wherein the antenna pattern is disposed in a non-display area of the display panel.

* * * * *